United States Patent [19]

Engeling et al.

[11] 4,175,699

[45] * Nov. 27, 1979

[54] SUPPLEMENTAL AIR CIRCULATOR FOR HOT-AIR FURNACES

[76] Inventors: Charles F. Engeling, R.R. #1, Morrisonville, Ill. 62546; Ralph F. Staubly, 84 Danbury, Springfield, Ill. 62704

[ * ] Notice: The portion of the term of this patent subsequent to Aug. 30, 1994, has been disclaimed.

[21] Appl. No.: 814,899

[22] Filed: Jul. 12, 1977

Related U.S. Application Data

[63] Continuation-in-part of Ser. No. 611,357, Sep. 8, 1975, Pat. No. 4,044,950.

[51] Int. Cl.[2] ..... F24B 7/02

[52] U.S. Cl. ..... 237/55; 126/110 R; 126/116 A; 165/DIG. 2

[58] Field of Search ..... 165/DIG. 2, 76, 137; 237/55; 126/110 R, 99 R, 113, 116 A, 177, 110 E

[56] References Cited

U.S. PATENT DOCUMENTS

| | | | |
|---|---|---|---|
| 1,558,848 | 10/1925 | Doble, Jr. | 126/116 A |
| 1,953,302 | 4/1934 | Johnston | 126/117 |
| 2,289,206 | 7/1942 | Nessell | 126/110 B |
| 2,362,940 | 11/1944 | Skerritt | 165/39 |
| 2,439,109 | 4/1948 | Stout | 126/117 |
| 2,962,218 | 11/1960 | Dibert | 237/55 |
| 3,009,643 | 11/1961 | Dibert | 237/55 |
| 3,472,496 | 10/1969 | Coleman et al. | 126/113 |
| 3,944,136 | 3/1976 | Huie | 237/55 |
| 4,044,950 | 8/1977 | Engeling et al. | 126/116 A |

*Primary Examiner*—Henry C. Yuen
*Attorney, Agent, or Firm*—Ralph F. Staubly

[57] ABSTRACT

A fuel-burning forced-air-circulating heating system having a thermostatically controlled heavy-duty blower, and a constantly operating or thermostatically controlled relatively low-powered supplemental air-circulating attachment for forcing air from the cold-air-return plenum to the hot-air-feed plenum of a conventional hot-air furnace. The supplemental attachment bypasses the furnace so that the air-flow resistance of the air filter of the furnace minimizes reverses air-flow through the furnace, resulting in a gentle temperature-equalizing (anti-stratification) circulation of air through the rooms being heated. Preferably, a thermostatic switch located close to a floor energizes the supplemental blower when needed to reduce temperature stratification in the heated space. Alternatively, or in addition, an outdoor thermostat can energize the supplemental blower in colder weather (when its operation is most needed).

2 Claims, 4 Drawing Figures

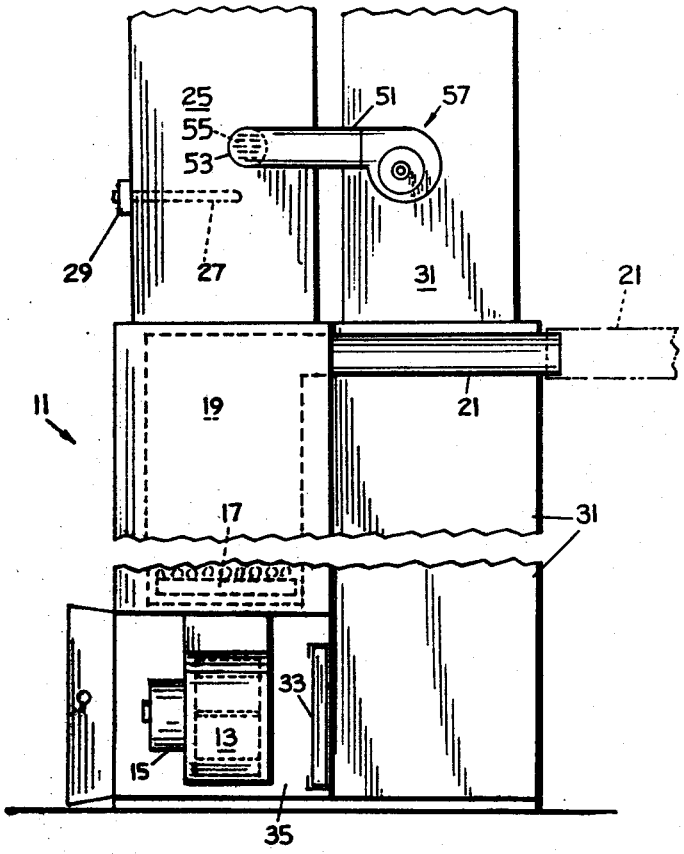
Fig. 1
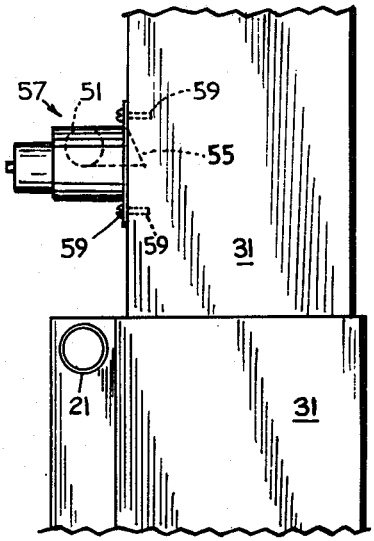
Fig. 2
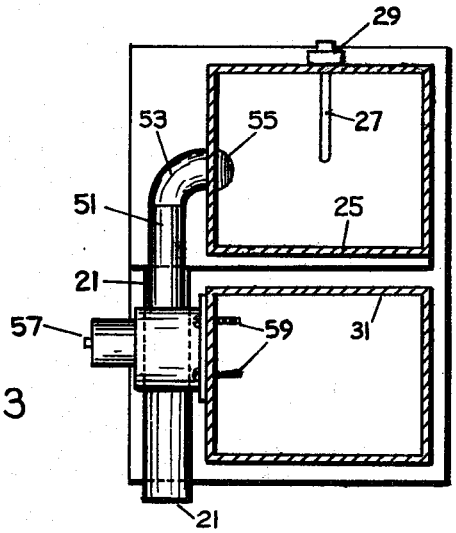
Fig. 3
Fig. 4
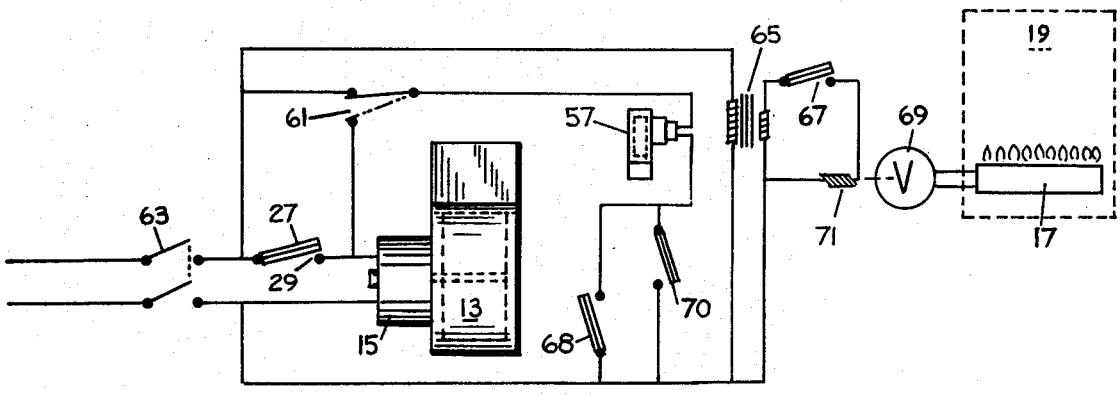

SUPPLEMENTAL AIR CIRCULATOR FOR HOT-AIR FURNACES

This application is a continuation-in-part of Ser. No. 611,357 (filed Sept. 8, 1975), now U.S. Pat. No. 4,044,950 which claimed broadly the herein-modified supplemental-air-circulator subcombination in combination with a flue-associated air-heating heat-exchanger.

BACKGROUND OF THE INVENTION

A few prior-art hot-air furnaces have employed two built-in blowers to vary the volume of air circulated for low and high heating phases, e.g. Kriechbaum U.S. Pat. No. 2,109,862 and Rifle U.S. Pat. No. 2,672,291. But in such furnaces usually both blowers and are high-powered, are not designed for attachment to existing furnaces.

SUMMARY AND OBJECTS OF THE INVENTION

The principal object of the invention is to provide an attachment for an installed conventional hot-air furnace, which attachment has a supplemental low-powered constantly energizable furnace-bypassing conduit system for reducing temperature gradients in the spaces being heated. Other objects and advantages will become apparent as the following description proceeds.

SHORT DESCRIPTION OF THE DRAWINGS

FIG. 1 is a front elevational view of a preferred embodiment of the invention.

FIG. 2 is a side elevational view of the upper two-thirds of FIG. 1, viewed from the right side of FIG. 1.

FIG. 3 is a plan view of the showing of FIG. 2.

FIG. 4 is a schematic wiring diagram of the system.

DETAILED DESCRIPTION

With reference now to the drawings, the numeral 11 generally designates a conventional hot-air furnace having a blower 13 energized by a motor 15, a fuel burner 17 in a combustion chamber 19, and a pipe 21 for discharging flue gases into a chimney (not shown). Furnace 11 further has a hot-air plenum 25 into which extends the thermostat 27 of a blower-controlling switch 29, and a cold-air-return plenum 31 which discharges through a filter 33 into a blower housing 35.

Air is pulled from the upper portion of the return plenum 31 by a relatively low-powered motor-driven blower 57, mounted (as by self-tapping screws 59) over an opening cut in said plenum. The outlet end of the blower 57 is connected by a pipe 51 to an elbow 53. The elbow 53 connects the pipe 51 to the hot-air plenum 25 by fitting into an aperture cut in said plenum. The inner end of the elbow 53 is desirably bridged by a plate 55 having upwardly angled louvers die-cut therein and bent to deflect air upwardly in the plenum 25. The motorized blower is of the order of a fifth of the power of the furnace blower 13–15, and is connected into the furnace circuit by a double-throw switch 61. The switch 61 permits the blower 57 to be energized constantly when the master switch 63 is closed, or to be energized only when the bonnet switch 27–29 is closed during a heating cycle.

The right third of FIG. 2 is the conventional circuitry of the original installation being modified, and comprises a stepdown transformer 65, a room thermostatic switch 67, and a valve 69 controlling the supply of fuel to the burner 17. The valve 69 (or an equivalent stoker-feeder motor) is controlled by a solenoid 71 energized by parts 65 and 67.

Instead of having constant energization of the supplemental blower 57, it is preferable to employ (1) an auxiliary room thermostatic switch 68 located adjacent the floor of a space being heated, and/or (2) an outdoor thermostatic switch 70, each set to operate the blower when stratification is most objectionable, that is when the air close to the floor is cold, due to long "off" periods or very low outdoor temperatures.

While the operation of the system of FIG. 4 is readily understandable, it should be noted that for mild weather, or if an air-cooling heat-exchanger should be installed in the hot-air plenum, it may be desirable to throw switch 61 to its dashed-line position so that the auxilliary blower will operate only during a cooling cycle.

Having thus described our invention, we claim:

1. In a forced-circulation air-heating system comprising a conventional fuel-burning hot-air furnace including a hot-air-feed duct system and a cold-air-return duct system, a pipe for conducting flue gases away from said furnace, a first thermostatic switch responsive to the temperature of the space to be heated, fuel-supply means controlled by said first thermostatic switch, a relatively high-power motorized blower for forcing air from said return system through said furnace and to said feed system, an air filter in the air-flow path to and through and from said furnace, a second thermostatic switch located in the hot-air portion of said air-flow path for energizing said high-power motorized blower upon a selected rise in furnace air temperature, the improvement comprising: a relatively low-power motorized blower, and duct means connecting said latter blower so as to force air from said return system into said feed system in bypassing relation to said furnace and its air filter, and means for energizing said low-power motorized blower, whereby during relatively non-heating periods when said high-power motorized blower and said furnace are inactivated, a gentle temperature-stratification-reducing air-flow is produced.

2. Structure according to claim 1, said means for energizing said low-power motorized blower comprising switch means for selectively connecting said low-power blower for either constant energization or energization only when outdoor temperature or close-to-floor indoor temperature dictates.

* * * * *